US007436361B1

(12) United States Patent
Paulsen et al.

(10) Patent No.: US 7,436,361 B1
(45) Date of Patent: Oct. 14, 2008

(54) LOW-LOSS DUAL POLARIZED ANTENNA FOR SATCOM AND POLARIMETRIC WEATHER RADAR

(75) Inventors: Lee M. Paulsen, Cedar Rapids, IA (US); Daniel N. Chen, Diamond Bar, CA (US); James B. West, Cedar Rapids, IA (US); Brian J. Herting, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 11/527,235

(22) Filed: Sep. 26, 2006

(51) Int. Cl.
*H01Q 1/38* (2006.01)
*H01Q 13/10* (2006.01)

(52) U.S. Cl. ..... 343/700 MS; 343/771

(58) Field of Classification Search ..... 343/700 MS, 343/771, 853

See application file for complete search history.

(56) References Cited

U.S. PATENT DOCUMENTS 4,843,400 A * 6/1989 Tsao et al. ..... 343/700 MS
5,170,174 A * 12/1992 Caer et al. ..... 343/771
6,133,877 A * 10/2000 Sandstedt et al. ..... 343/700 MS
6,864,840 B2 * 3/2005 Zhu et al. ..... 343/700 MS
6,958,729 B1 * 10/2005 Metz ..... 343/700 MS
6,977,614 B2 * 12/2005 Poe et al. ..... 343/700 MS

* cited by examiner

*Primary Examiner*—Tan Ho
(74) *Attorney, Agent, or Firm*—Nathan O. Jensen; Kyle Eppele

(57) ABSTRACT

The present invention is a low-loss polarized antenna for satellite communications and polarimetric weather radar. The antenna may comprise: (a) a microstrip patch antenna, (b) a waveguide, and (c) a coupling interface between the antenna and waveguide. The microstrip patch antennas may individually comprise: (i) a patch radiator having a defined area, and (ii) an associated microstrip.

In a further embodiment of the invention, an antenna array is presented. The antenna array may comprise: (a) a plurality of microstrip antennas, and (b) a plurality of waveguides. The antenna array may further comprise: (c) a waveguide combiner. The microstrip patch antennas may individually comprise: (i) a patch radiator having a defined area, and (ii) an associated microstrip.

In still a further embodiment of the invention, a method for the manufacturing of an antenna is presented. The method may comprise the step: (a) operably coupling a microstrip patch antenna to a waveguide.

16 Claims, 6 Drawing Sheets

LOW-LOSS DUAL POLARIZED ANTENNA FOR SATCOM AND POLARIMETRIC WEATHER RADAR

FIELD OF THE INVENTION

This invention relates generally to the transmission and reception of radio frequency signals and, more particularly to a low-profile, low-loss antenna apparatus.

BACKGROUND OF THE INVENTION

In many telecommunications applications, microstrip antennas are employed. There are several types of microstrip antennas (also known as printed antennas), the most common of which is the microstrip patch antenna. A microstrip patch antenna is a narrowband, wide-beam antenna fabricated by etching an antenna element pattern in metal trace bonded to an insulating substrate. Because such antennas may be low profile, mechanically rugged and conformable, they are often employed on aircraft and spacecraft, or are incorporated into mobile radio communications devices.

Microstrip antennas are also relatively inexpensive to manufacture and design because of the simple 2-dimensional physical geometry. An advantage inherent to patch antennas is the ability to either transmit or receive (i.e. transceive) electromagnetic signals having polarization diversity. Patch antennas can easily be designed to have Vertical, Horizontal, Right Hand Circular (RHCP) or Left Hand Circular (LHCP) Polarizations with a single antenna feedpoint. This unique property allows patch antennas to be used in many types of communications links that may have varied requirements.

Another potential improvement for modern communications devices is the incorporation of waveguide architectures. Waveguides represent an effective mechanism for conveying signals with very little degradation or loss. Waveguides are commonly used in microwave communications, broadcasting, and radar installations. A waveguide consists of a rectangular or cylindrical metal tube or pipe. The electromagnetic field propagates lengthwise.

To function properly, a waveguide must have a certain minimum cross-sectional dimensions relative to the wavelength of the desired signal. If the waveguide is too narrow or the frequency is too low (i.e. the wavelength is too long), the electromagnetic fields cannot propagate. At any frequency above the cutoff (the lowest frequency at which the waveguide is large enough), the feed line will work well, although certain operating characteristics vary depending on the number of wavelengths in the cross section.

Mobility is a prime concern in the design of modern communications systems. Users are more likely than ever to require information in a variety of locales, thereby necessitating efficient mechanisms for ensuring the integrity of communicated data while minimizing the physical dimensions of individual communication system devices. Airborne TV antenna systems present a unique design challenge. Such antennas must be light weight, inexpensive, and capable of receiving dual circular-polarization (CP) radio frequency (RF) signals. Additionally, in order to be tail-mount compatible with medium size aircraft, the antennas must be able to fit in a package on the order of a 9" swept volume.

Additionally, many current weather radars, including NEXRAD, transmit and receive radio waves with a single, horizontal polarization. However, the next generation of functionality in radar systems, such as polarimetric radar, may require a dual linear-polarization (LP) aperture.

As such it would be desirable to provide a low cost, light weight, high efficiency radiating antenna architecture capable of dual CP operation in an aircraft tail-mount compatible footprint or dual LP operation in weather radar.

SUMMARY OF THE INVENTION

Accordingly, the present invention is directed to a low-loss, dual polarized antenna. In general, the invention applies to systems where a microstrip patch antenna is combined with a waveguide for the transmission or reception of electromagnetic signals.

In an embodiment of the invention, a low-loss, dual polarized antenna is presented. The antenna may comprise: (a) a microstrip patch antenna, (b) a waveguide, and (c) a coupling interface between the antenna and waveguide. The microstrip patch antennas in the array may individually comprise: (i) a patch radiator having a defined area, and (ii) an associated microstrip. The configuration of the microstrip may dictate the polarity and phase of the signal that is either transmitted or received by the microstrip patch antenna. The polarity may be dual linearly-polarized or dual circularly polarized.

In a further embodiment of the invention, an antenna array is presented. The antenna array may comprise: (a) a plurality of microstrip antennas, and (b) a plurality of waveguides. The antenna array may further comprise: (c) a waveguide combiner.

In still a further embodiment of the invention, a method for the manufacturing of an antenna is presented. The method may comprise the step: (a) operably coupling a microstrip patch antenna to a waveguide.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DETAILED DESCRIPTION OF THE INVENTION

Figure 1:
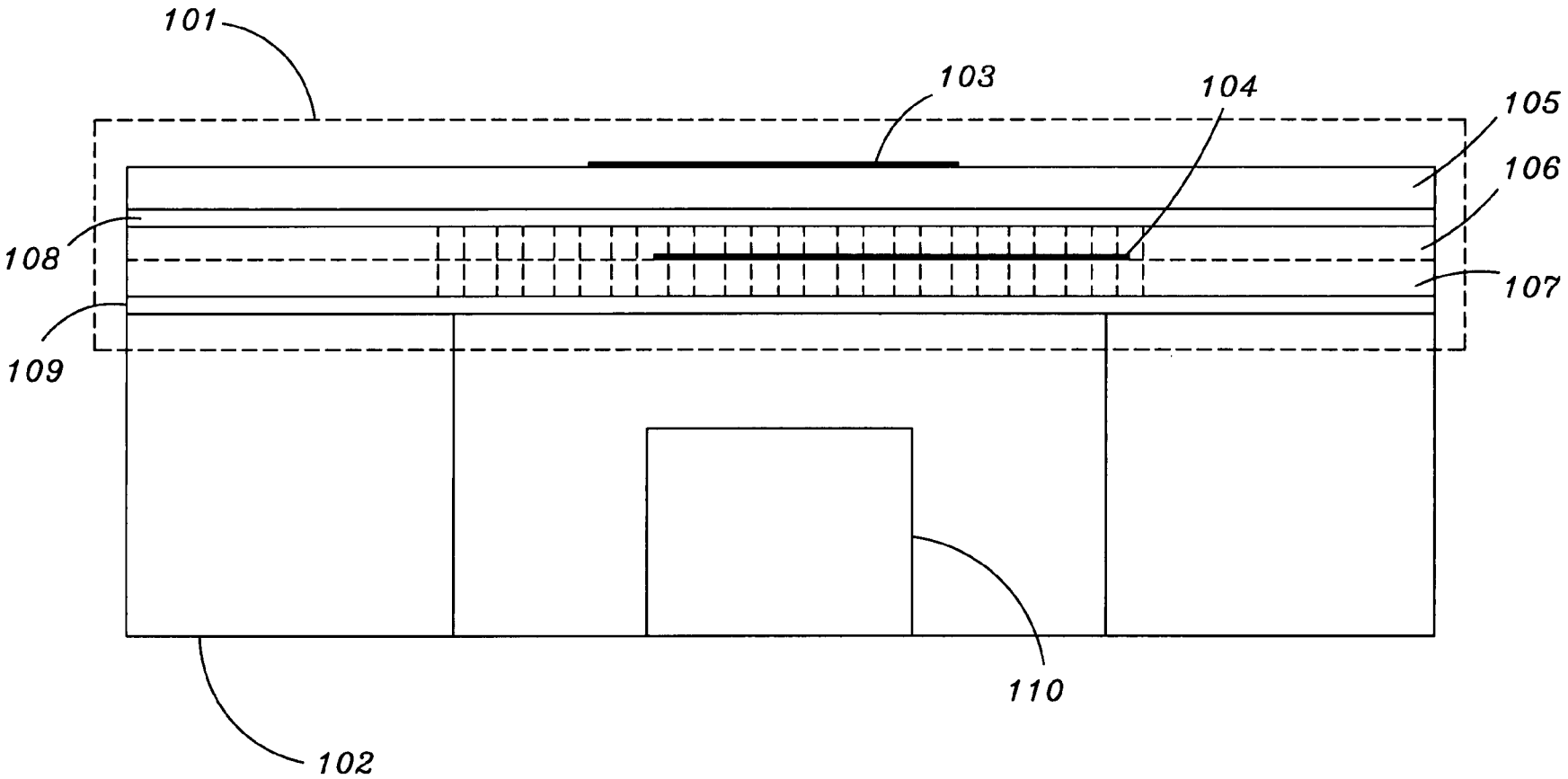
FIG. 1 depicts a cross-sectional representation of an antenna in accordance with an embodiment of the present invention.

The following discussion is presented to enable a person skilled in the art to make and use the present teachings. Various modifications to the illustrated embodiments will be readily apparent to those skilled in the art, and the generic principles herein may be applied to other embodiments and applications without departing from the present teachings. Thus, the present teachings are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of the present teachings. Skilled artisans will recognize the examples provided herein have many useful alternatives and fall within the scope of the present teachings. Reference will now be made, in detail, to presently preferred embodiments of the invention, examples of which are illustrated in the accompanying drawings.

Referring to FIG. 1, a cross-sectional representation of a microstrip patch antenna 100 in accordance with an embodiment of the present invention is presented. The antenna comprises a microstrip patch antenna 101 and a waveguide 102 disposed substantially adjacent the microstrip patch antenna. The microstrip patch antenna is comprised of a patch element 103, a stripline 104, a first dielectric layer 105, a second dielectric layer 106, a third dielectric layer 107, a first ground plane 108, a second ground plane 109, and coupling mechanisms for transferring signals between the patch element 103 and stripline 104 and between the stripline 104 and waveguide 102.

The patch element 103 can be a relatively thin sheet of metal or other material having metallic properties capable of emitting or receiving electromagnetic signals. The patch element 103 is disposed on a first side of the first dielectric layer 105.

The first ground plane 108 is disposed on the second side of the first dielectric layer 105. The second dielectric layer 106 and third dielectric layer 107 are disposed between the first ground plane 108 and the second ground plane 109.

The stripline 104 is disposed between the second dielectric layer 106 and third dielectric layer 107. The stripline 104 may be configured so that the antenna receives or emits polarized electromagnetic signals, as will be further discussed.

The waveguide 102 is used as a low-loss conduit between the microstrip patch antenna and an external device capable of generating and/or processing electromagnetic signals (not pictured). The waveguide 102 may comprise a substantially rectangular raised ridge 110 disposed along the length of the waveguide.

Figure 2:
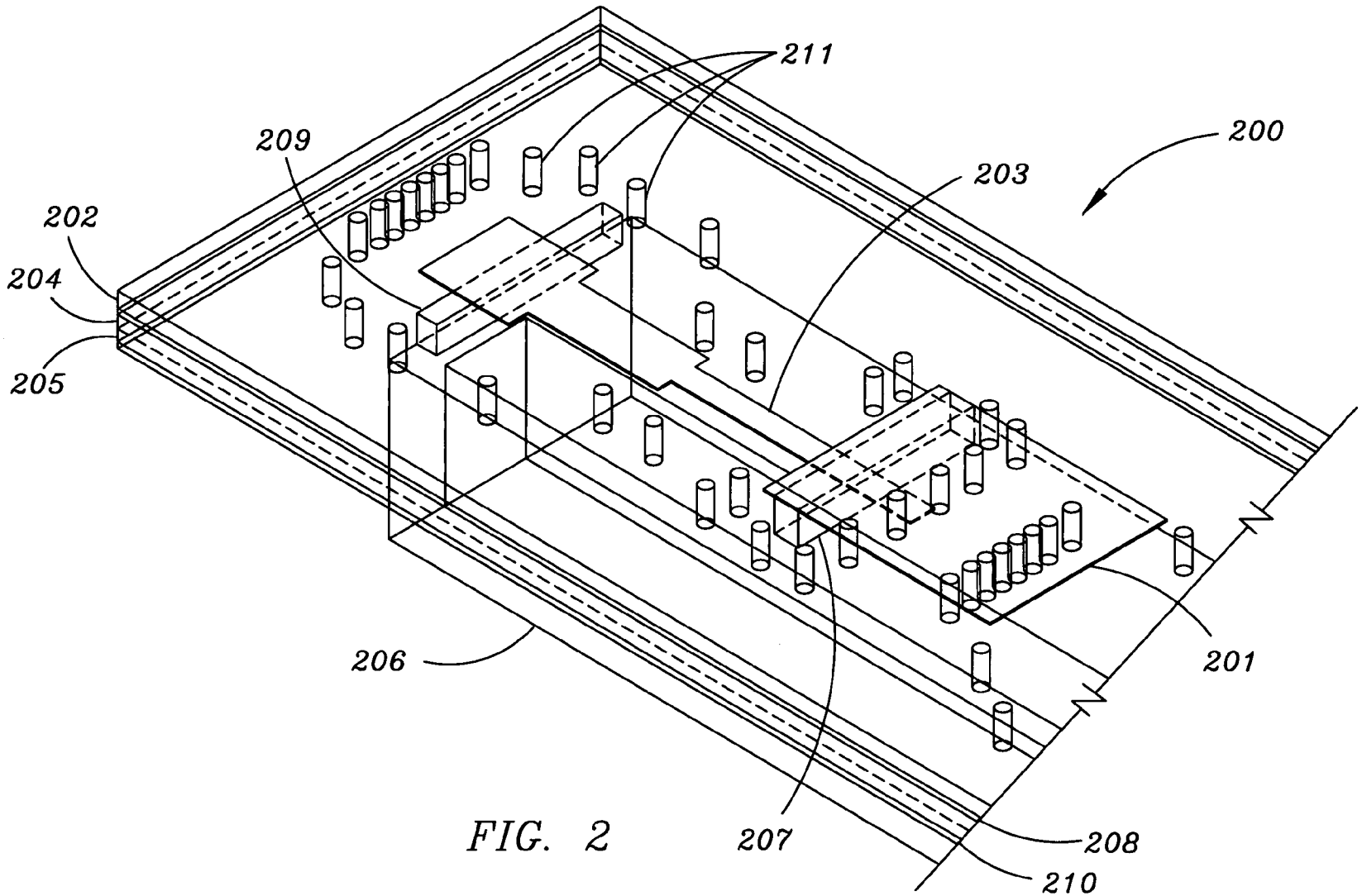
FIG. 2 depicts an axonometric representation of a microstrip patch antenna and waveguide in accordance with an embodiment of the present invention.

Referring to FIG. 2, an axonometric representation 200 of a microstrip patch antenna and waveguide in accordance with an embodiment of the present invention is presented. A patch element 201 is disposed on a first surface of a first dielectric layer 202 and a stripline 203 is disposed between a second dielectric layer 204 and a third dielectric layer 205. The respective couplings between a waveguide 206 and stripline 203, and stripline 203 and patch element 201 can be accomplished in any number of standard ways. In the depicted embodiment, a first open-space slot 207 is disposed in a first ground plate 208 presenting a conduit between the patch element 201 and the stripline 203. A second open-space slot 209 is disposed in a second ground plate 210 presenting a conduit between the stripline 203 and the waveguide 206. In further embodiments, the respective couplings between the waveguide 206 and stripline 203, and stripline 203 and patch element 201 may be selected from the group comprising: probe coupling, proximity coupling, or edge feeding.

The microstrip patch antenna may also comprise a plurality of circuit board vias 211 disposed within the second dielectric layer 204 and the third dielectric layer 205 and linking the first ground plate 208 and the second ground plate 210. The board vias may comprise generally cylindrical holes through the second dielectric layer 204 and third dielectric layer 205 which are plated with a conducting material. The circuit board vias serve to extinguish "parallel plate" modes within the stripline structure. The vias tie the ground layers 207 and 208 together and so as to extinguish potential differences to exist across them. The stripline is thus permitted to act as the conductor while the top and bottom layers are at "ground" potential.

Figure 3:
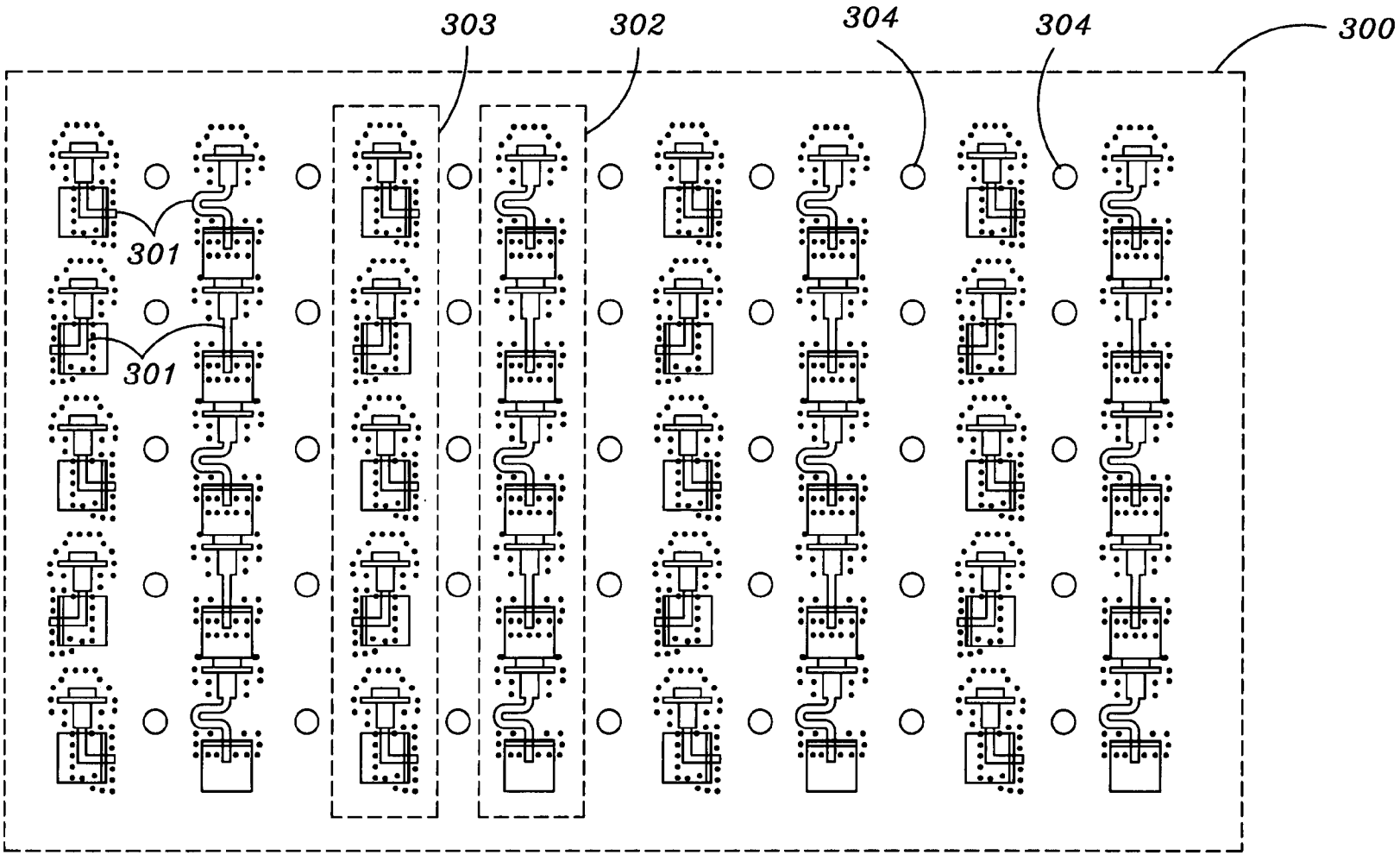
FIG. 3 depicts an antenna array comprising a plurality of microstrip patch antennas in accordance with an embodiment of the present invention.

Referring to FIG. 3, an antenna array comprising a plurality of microstrip patch antennas 300 in accordance with an embodiment of the present invention is presented. The plurality of microstrip patch antennas 300 may be arranged in a rectangular or other close-packed geometric pattern. The striplines 301 of each of the plurality of microstrip patch antennas 300 may be individually configured for vertical, horizontal, dual linear or circular polarity in a transceived signal. In the presently depicted embodiment, antenna sub-arrays 302 configured for vertical polarity and antenna sub-arrays 303 configured for horizontal polarity are combined to form an array so as to jointly result in dual linear polarity. In a further embodiment, the sub arrays 302 and 303 may comprise 90°-hybrid microstrip patch antennas, such as those commonly found in the art, so as to result in circular polarity. The antenna array may be operably connected to a plurality of waveguides (not pictured) via any number of methods including chemical adhesion, solder, mechanical clamps, rivets or screws. In the depicted embodiment, board-compression screw holes 304 are provided.

Figure 4:
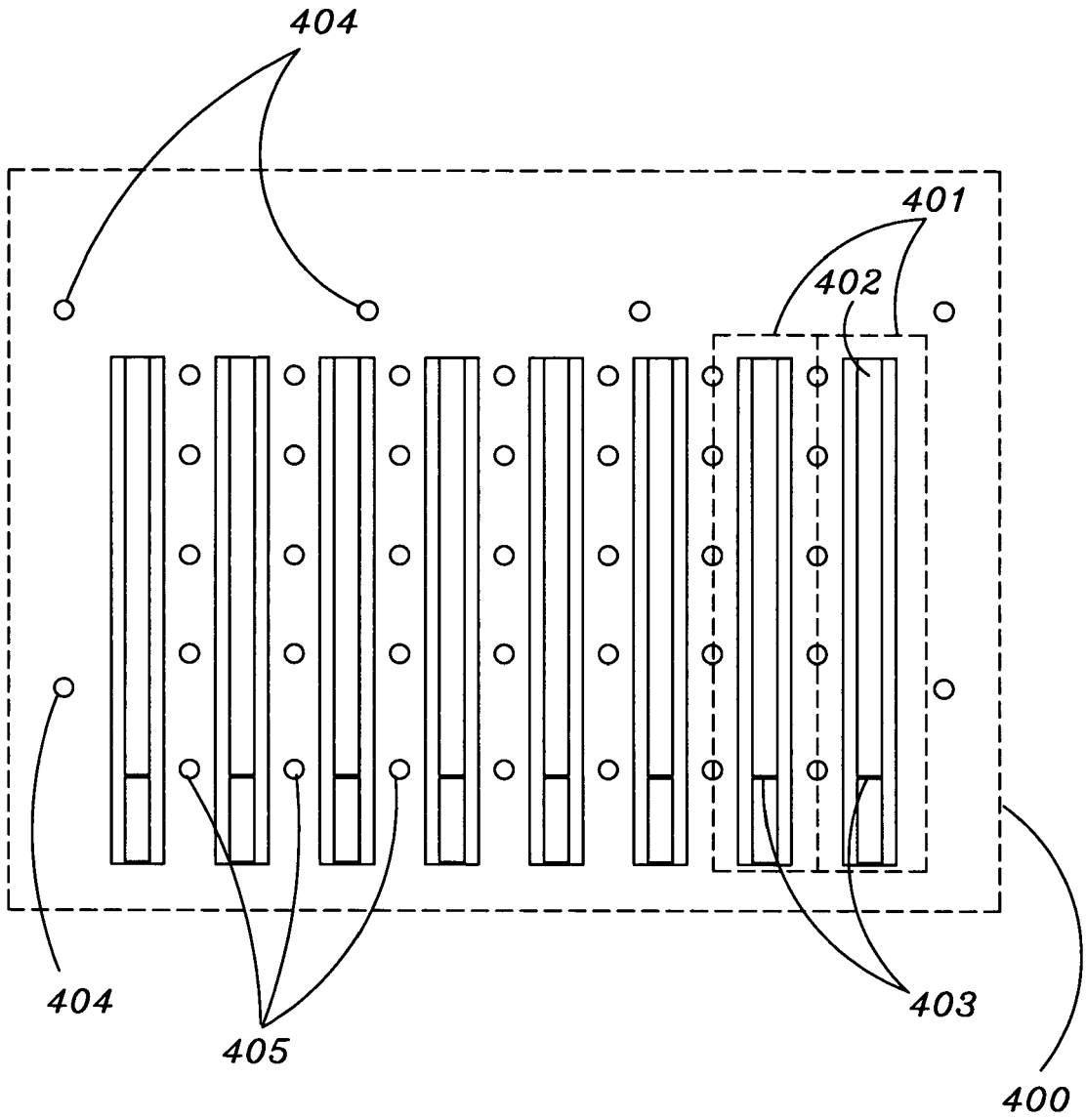
FIG. 4 depicts a plurality of waveguides in accordance with an embodiment of the present invention.

Referring to FIG. 4, a plurality of waveguides 400 in accordance with the present invention is presented. A waveguide 401 may comprise a linear structure having a substantially hollow rectangular cross-section and being disposed substantially adjacent to a microstrip sub-array such as that of FIG. 3. The waveguide may be manufactured from any number of electromagnetically conductive materials including brass, copper, silver, aluminum, or any other metal that has low bulk resistivity.

The waveguide 401 may also comprise a ridge 402 disposed along the center length of the individual waveguides so as to compress the lateral dimensions of a signal and ensure very low signal degradation or loss. The waveguide design dimensions are a function of the designated frequencies of operation. The significant dimension is the width of the ridge waveguide. In a particular embodiment of the invention, adjacent ridged waveguides 401 feed opposite polarizations (i.e. horizontal and vertical). As such, the effective spacing 402 for each waveguide (and thus microstrip each patch antenna sub-array) is twice the waveguide width. In order to maintain high operating performance and avoid grating lobes, the spacing must be less than a free-space wavelength. Regular non-ridged waveguides may not support array spacing this small. As such, a ridge waveguide may be used.

Each waveguide may further comprise a coupling mechanism providing a conduit for signal transfer from the waveguide 401 to a waveguide combiner (not pictured). The coupling mechanism may be may be selected from slot coupling probe coupling, proximity coupling, or edge feeding. In the presently depicted embodiment, a slot couple 403 is utilized.

The waveguide may be operably connected to the waveguide combiner via any number of methods including chemical adhesion, solder, mechanical clamps, rivets or screws. In the depicted embodiment, board-compression screw holes 404 are provided.

The waveguide may be operably connected to a microstrip patch antenna array (not pictured) via any number of methods including chemical adhesion, solder, mechanical clamps, rivets or screws. In the depicted embodiment, board-compression screw holes 405 are provided.

Figure 5:
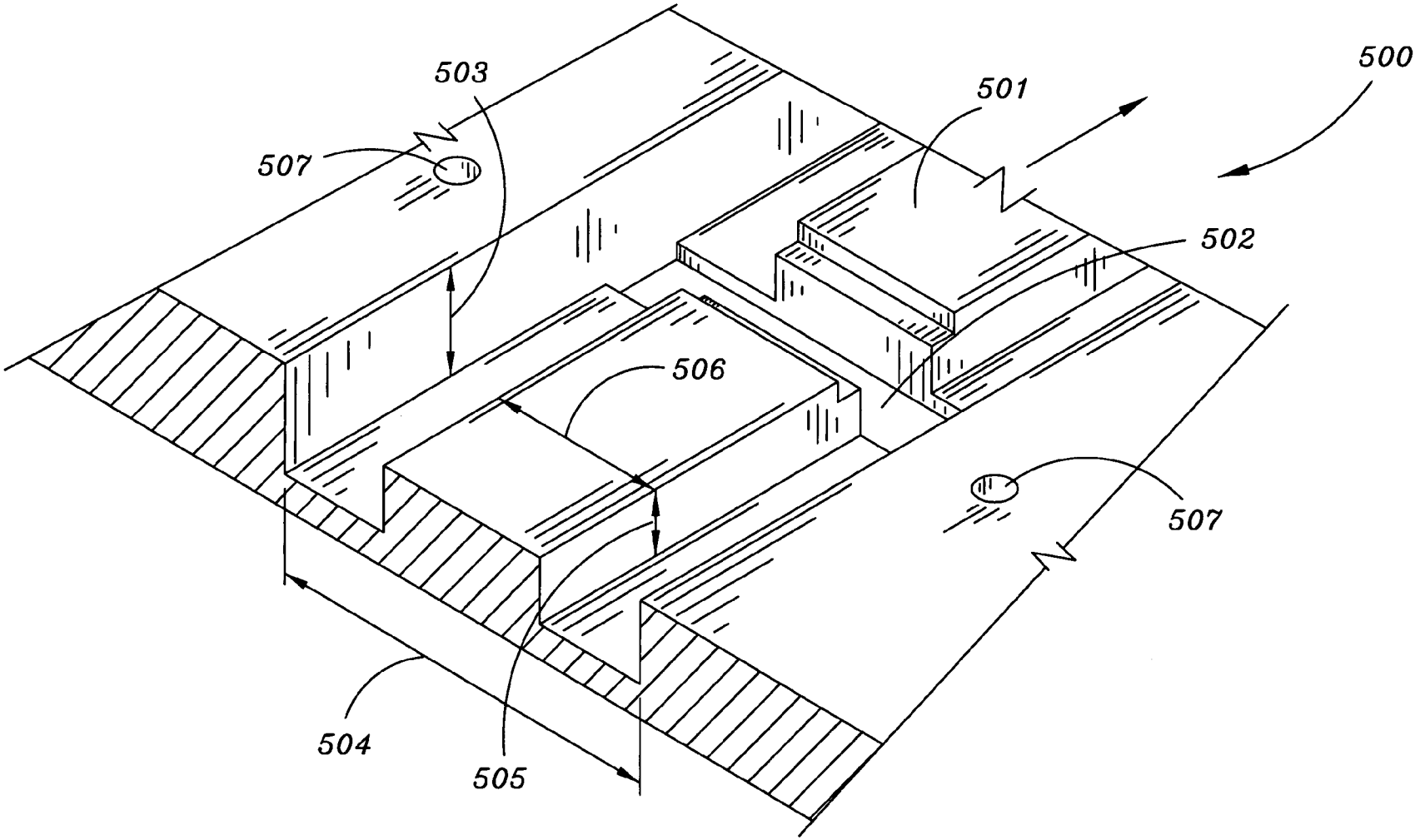
FIG. 5 depicts an axonometric view of a waveguide in accordance with an embodiment of the present invention.

Referring to FIG. 5, an axonometric view of a waveguide 500 in accordance with the present invention is presented. The waveguide 500 may comprise a ridge 501 disposed along the center length of the waveguide so as to compress the lateral dimensions of a signal and ensure very low signal degradation or loss. In a particular embodiment, the waveguide 500 and ridge 501 may have dimensions such that the waveguide structure is capable of transceiving direct broadcast satellite (DBS) signals such as DirecTV™. Such DBS signals are on the order of 12.2-12.7 GHz. In a further embodiment, the waveguide 500 and ridge 501 may have dimensions such that it is capable of transceiving polarimetric radar signals. Such polarimetric radar signals are on the order of 9.3-9.4 GHz. In still a further embodiment, the waveguide may have a height 503 of from 2.8 mm to 19.0 mm and a width 504 of from 5.7 mm to 38.1 mm. In still a further embodiment, the waveguide may have a height 503 of 12.5 mm and a width 504 of 25.0 mm.

In still a further embodiment, the waveguide ridge 501 may have a height 505 of from 1.75 mm to 11.9 mm and a width 506 of from 2.28 to 15.24 mm. In still a further embodiment, the waveguide ridge may have a height 505 of 7.8 mm and a width 506 of 10.0 mm.

The waveguide may be operably connected to a microstrip patch antenna array via any number of methods including chemical adhesion, solder, mechanical clamps, rivets or screws. In the depicted embodiment, board-compression screw holes 507 are provided.

Figure 6:
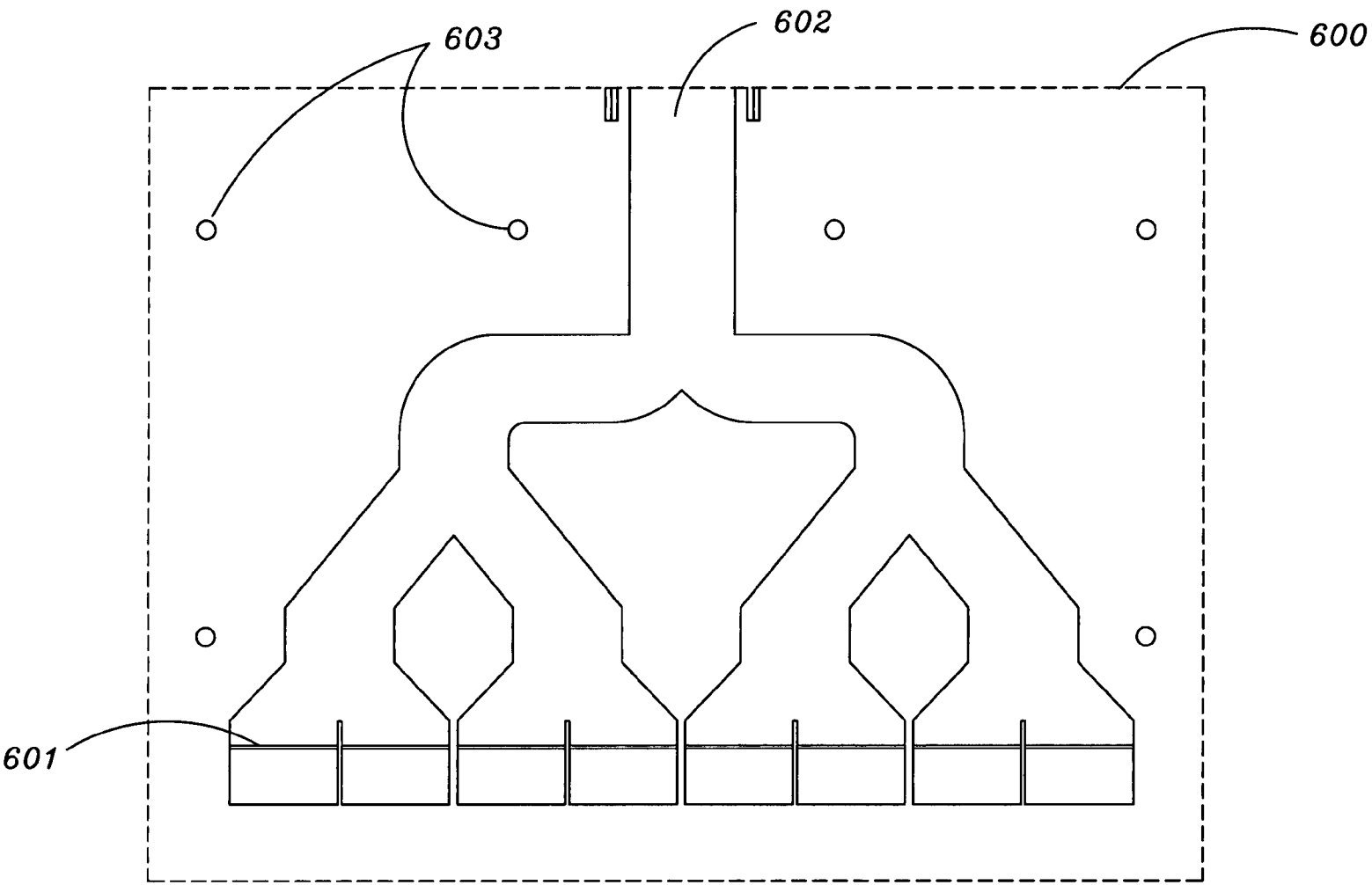
FIG. 6 depicts a waveguide combiner in accordance with an embodiment of the present invention.

Referring to FIG. 6, a waveguide combiner 600 in accordance with the present invention is presented. The combiner is capable of receiving multiple instances of a common signal from a series of inputs and combining them to increase the overall signal strength. The combiner 600 may comprise a plurality of inputs 601 which are combined to sum to a single output 602. The inputs may comprise a coupling mechanism for the transfer of signals from a plurality of waveguides. The coupling mechanism may be may be selected from slot coupling, probe coupling, proximity coupling, or edge feeding. In the presently depicted embodiment, a slot couple 601 is presented.

The waveguide combiner 600 may be operably connected to a plurality of waveguides (not pictured) via any number of methods including chemical adhesion, solder, mechanical clamps, rivets or screws. In the depicted embodiment, board-compression screw holes 603 are provided.

It is believed that the present invention and many of its attendant advantages will be understood from the foregoing description, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An apparatus for transceiving electromagnetic signals, the apparatus comprising:

a microstrip patch antenna, the microstrip patch antenna comprising:

a patch radiator; and a microstrip;

a waveguide, the waveguide comprising a ridge disposed along the length of the waveguide; and slot couple interface operably coupling the microstrip of the microstrip patch antenna to the waveguide.

2. The apparatus of claim 1, wherein the microstrip is configured to transceive polarized electromagnetic signals.

3. An apparatus for transceiving electromagnetic signals, the apparatus comprising:

a plurality of microstrip patch antennas, each of the microstrip patch antennas comprising:

a patch radiator, and a microstrip;

at least one waveguide, the at least one waveguide comprising a ridge disposed along the length of the waveguide;

a plurality of slot couple interfaces operably coupling the microstrips of the plurality of microstrip patch antennas to the at least one waveguide.

4. The apparatus of claim 3, wherein the plurality of microstrip antennas are collectively configured to transceive dual-polarized electromagnetic signals.

5. The apparatus of claim 4, wherein the dual-polarized electromagnetic signals are linearly polarized.

6. The apparatus of claim 5, wherein the dual polarized electromagnetic signals are polarimetric radar signals.

7. The apparatus of claim 4, wherein the dual-polarized electromagnetic signals are circularly polarized.

8. The method of claim 7, wherein the dual polarized electromagnetic signals are direct broadcast satellite (DBS) signals.

9. The apparatus of claim 3, further comprising:

a waveguide combiner; and a plurality of interfaces operably coupling the at least one waveguide to the waveguide combiner.

10. A method for manufacturing an antenna, the method comprising the step:

operably coupling microstrips of a plurality of microstrip patch antennas to at least one waveguide via a slot couple, each of the microstrip patch antennas of the plurality of microstrip patch antennas comprising:

a patch radiator, and the microstrip;

the waveguide comprising:

a ridge along the center length of the waveguides.

11. The method of claim 10, further comprising:

operably coupling the at least one waveguides to a waveguide combiner.

12. The method of claim 10, wherein the microstrips are collectively configured to transceive dual polarized electromagnetic signals.

13. The method of claim 12, wherein the dual polarized electromagnetic signals are linearly polarized.

14. The method of claim 13, wherein the dual polarized electromagnetic signals are polarimetric radar signals.

15. The method of claim 12, wherein the dual polarized electromagnetic signals are circularly polarized.

16. The method of claim 15, wherein the dual polarized electromagnetic signals are direct broadcast satellite (DBS) signals.

* * * * *